United States Patent [19]

Carlson

[11] 4,112,966

[45] Sep. 12, 1978

[54] EJECTOR PURGE HYDRANT

[75] Inventor: Donald E. Carlson, Highland Park, Ill.

[73] Assignee: Mark Controls Corporation, Lake Zurich, Ill.

[21] Appl. No.: 745,603

[22] Filed: Nov. 29, 1976

[51] Int. Cl.[2] ..... E03B 9/14

[52] U.S. Cl. ..... 137/282; 137/305; 251/54

[58] Field of Search ..... 137/272, 281–285, 137/301–306

[56] References Cited

U.S. PATENT DOCUMENTS

| | | | |
|---|---|---|---|
| 2,481,909 | 9/1949 | Dales et al. | 137/282 |
| 2,635,621 | 4/1953 | Hansen | 137/282 X |
| 2,665,710 | 1/1954 | McGarry et al. | 137/282 X |

FOREIGN PATENT DOCUMENTS

| | | | |
|---|---|---|---|
| 216,870 | 12/1949 | Fed. Rep. of Germany | 137/282 |

*Primary Examiner*—Martin P. Schwadron

*Assistant Examiner*—Richard Gerard

[57] ABSTRACT

A hydrant for controlling the flow of water from an underground supply includes a casing connected at its lower end to the supply and its upper end to a nozzle for delivery of water from the casing. The flow of water from the supply to the casing is controlled by a main valve operated by a handle on the hydrant casing. An ejector purge apparatus drains the casing after the flow of water through the casing has been terminated by the main valve in order to prevent frost damage. The ejector purge apparatus includes a purge valve controlling flow from the supply through a conduit to a location outside of the hydrant casing. The conduit includes a flow constricting element and a port adjacent the flow constricting element that is in fluid communication with the casing. Flow through the purge valve and the flow constricting element results in venturi evacuation of the water within the casing. The purge valve is maintained in an open position for a limited time by a motion dampening dash pot after closure of the main valve to allow complete evacuation.

14 Claims, 3 Drawing Figures

EJECTOR PURGE HYDRANT

BACKGROUND OF THE INVENTION

1. Field of the Invention

The present invention relates to hydrants, and more particularly to a new and improved ejector purge assembly for draining water from the casing of a yard hydrant to prevent contamination of the water supply and front damage to the hydrant.

2. Description of the Prior Art

Yard hydrants are often used to supply water from a source below the frost line. It is undesirable for a yard hydrant, after being used, to retain water within that portion of the hydrant casing above the frost line. Such retention of water in the casing could result in damage to the hydrant if the water freezes. Moreover, residual water could become contaminated.

To overcome these problems many prior art hydrants include a bleed opening leading from the bottom of the hydrant casing to a below grade gravel pit. When the hydrant is turned on, the bleed passage is closed by the main valve; and once the hydrant is turned off, the bleed hole is opened allowing water to drain from the casing. An example of such a typical prior art yard hydrant is disclosed in U.S. Pat. No. 3,070,116.

One disadvantage with such an arrangement is that ground water contaminants can enter the hydrant casing through the bleed line resulting in unsanitary water that, when the hydrant is again turned on, can be mixed with the water supplied from the spout or head of the hydrant. Accordingly, a current goal in the industry is to provide a yard hydrant that is both frostproof and sanitary.

One solution to the problem of attaining a frost proof and sanitary yard hydrant includes a bleed line that extends through an above grade siphon that includes a check valve and air gap. The air gap serves to prevent migration of contaminants through the liquid media after draining of the casing and prior to the next operation of the hydrant. A hydrant of this type is disclosed in U.S. Pat. No. 3,858,599.

Another solution to the problem of providing a hydrant that is both sanitary and frostproof is a hydrant having a casing with a reservoir below the frost line into which supply water drains when the hydrant valve is closed. When the hydrant is next opened, the reservoir is emptied through the hydrant spout by venturi action. Such a hydrant is disclosed in U.S. Pat. No. 3,885,585. One disadvantage with this prior art hydrant is that water can be held in the reservoir for extended periods of time after which it is ejected from the spout. This water can become stale or contaminated due to the extended period of storage. In addition, a restriction, such as that provided by a long hose or a vacuum breaker, at the spout can interfere with the intended operation of the hydrant by rendering the venturi action ineffective.

SUMMARY OF THE INVENTION

An object of the present invention is to provide a new and improved sanitary and frostproof yard water hydrant.

Another object of the present invention is to provide a new and improved arrangement for purging fluid remaining in the casing of a yard hydrant after operation.

A further object of the present invention is to provide a new and improved purging apparatus for a yard hydrant with a time of operation automatically controlled and which can be used regardless of the existence of a restriction at the spout of the hydrant.

Briefly, the present invention is directed to a new and improved purging apparatus for draining water from the casing of a yard hydrant after water flow through the hydrant has been terminated by a main valve controlled by a handle. The main valve controls the flow of water from a source to the casing of the hydrant.

The hydrant includes a purge apparatus including a purge valve that controls a small flow of water from the source through a conduit having a fluid flow constricting element. The conduit is connected to a point outside of the casing and includes an air gap to prevent contamination. The flow constricting element is part of a venturi system including several ports in fluid communication with the interior of the hydrant crossing. Accordingly, the small flow of water through the flow constricting element entrains the water contained within the casing thereby effecting venturi evacuation of the hydrant casing.

The movement of the purge valve from its open to closed positions is delayed by a dash pot that is cocked upon actuation of the hydrant handle to open the main valve. The dash pot holds the purge valve in an open position immediately after the closing of the main valve. After a predetermined period of time, the purge valve closes terminating the flow of water through the flow constricting element and, thus, the venturi evacuation of the hydrant casing.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
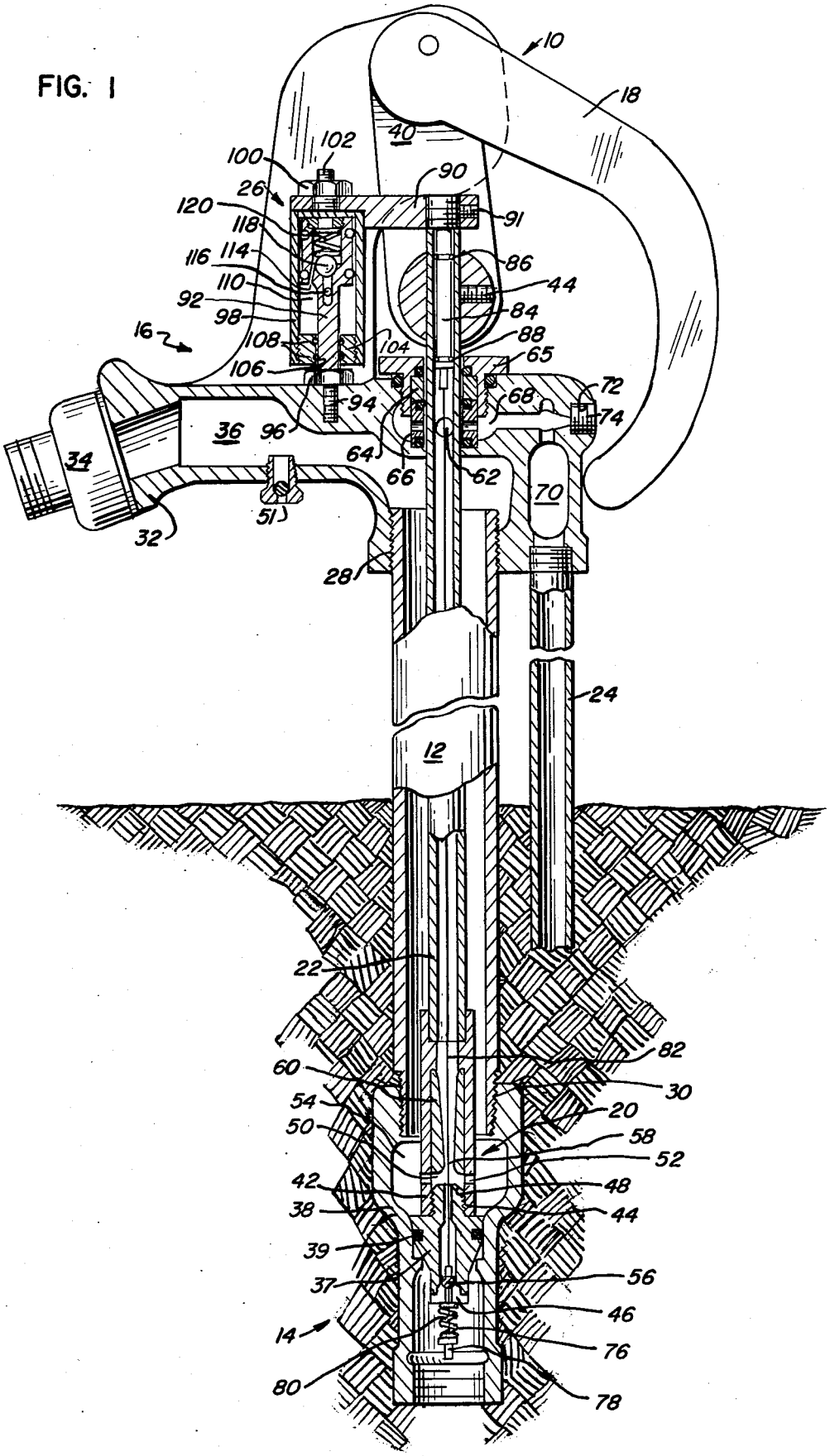
FIG. 1 is a fragmentary, side elevational view, partly in section, of a hydrant constructed in accordance with the principles of the present invention.

Referring now to the drawings, there is illustrated a yard hydrant constructed in accordance with the principles of the present invention and designated as a whole by the reference numeral 10. In general, the hydrant 10 includes a hollow casing or housing 12 extending from a main supply valve assembly generally designated as 14 located in the ground below the frost line to a head assembly designated as 16 disposed at a convenient elevation above ground. An operating handle 18 controls the main valve assembly 14 selectively to admit water to the casing 12 and the head assembly 16 from a suitable below ground water supply (not shown).

In accordance with important features of the present invention, the hydrant 10 is provided with novel structure for draining water from the casing 12 after use and for preventing contamination of the fluid supply. In order to drain the hydrant 10 there is provided an ejector-purge apparatus designated generally as 20. The ejector-purge apparatus 20 is in fluid communication through a purge conduit 22 and a bleed tube pipe 24 with a below grade drainage sump or gravel pit (not shown) located at a point outside of the casing 12. The duration of the operation of the ejector purge apparatus 20 that is required to drain the casing 12 is controlled by a pneumatic or hydraulic time delay dashpot mounted within the head assembly 16 and generally designated as 26.

Proceeding now to a more detailed description of the structure and operation of the hydrant 10, the casing 12 includes upper 28 and lower 30 threaded ends for connecting the casing 12 to the head assembly 16 and to the main valve assembly 14, respectively, thereby allowing fluid from the fluid source as controlled by the main valve assembly 14 to be communicated to the head assembly 16. Once fluid is communicated to the head assembly 16 the fluid is directed for use outside of the hydrant 10 through a nozzle or spout 32. The nozzle 32 may have attached thereto a backflow preventer 34, such as that disclosed in U.S. Pat. No. 3,850,190. The upper end 28 of the casing 12 communicates with the nozzle 32 through a chamber 36 fabricated in the head assembly 16.

Control of fluid from the fluid source through the casing 12 to the nozzle 32 of the hydrant 10 is controlled by the main valve assembly 14 and, specifically, by a main valve element 37. The main valve element 37 includes a O-ring 39 that seats in a reduced diameter portion of the main valve body 38 to prevent fluid flow from the fluid source to the casing 12 (FIG. 1). Flow from the source to the casing 12 is initiated by raising the main valve element 37 out of seating engagement with valve body 38. Valve element 37 is raised by lifting the handle 18 to the open position illustrated in FIG. 2.

More specifically, handle 18 is connected in a manner well known in the art by link 40 to the upper end of the purge conduit 22 through the employment of the set screw 44. The lower end of the purge conduit 22 is connected to the ejector purge apparatus 20. In this manner the element 22 serves both as a purge conduit and as the operating rod for the main valve element 37.

Figure 2:
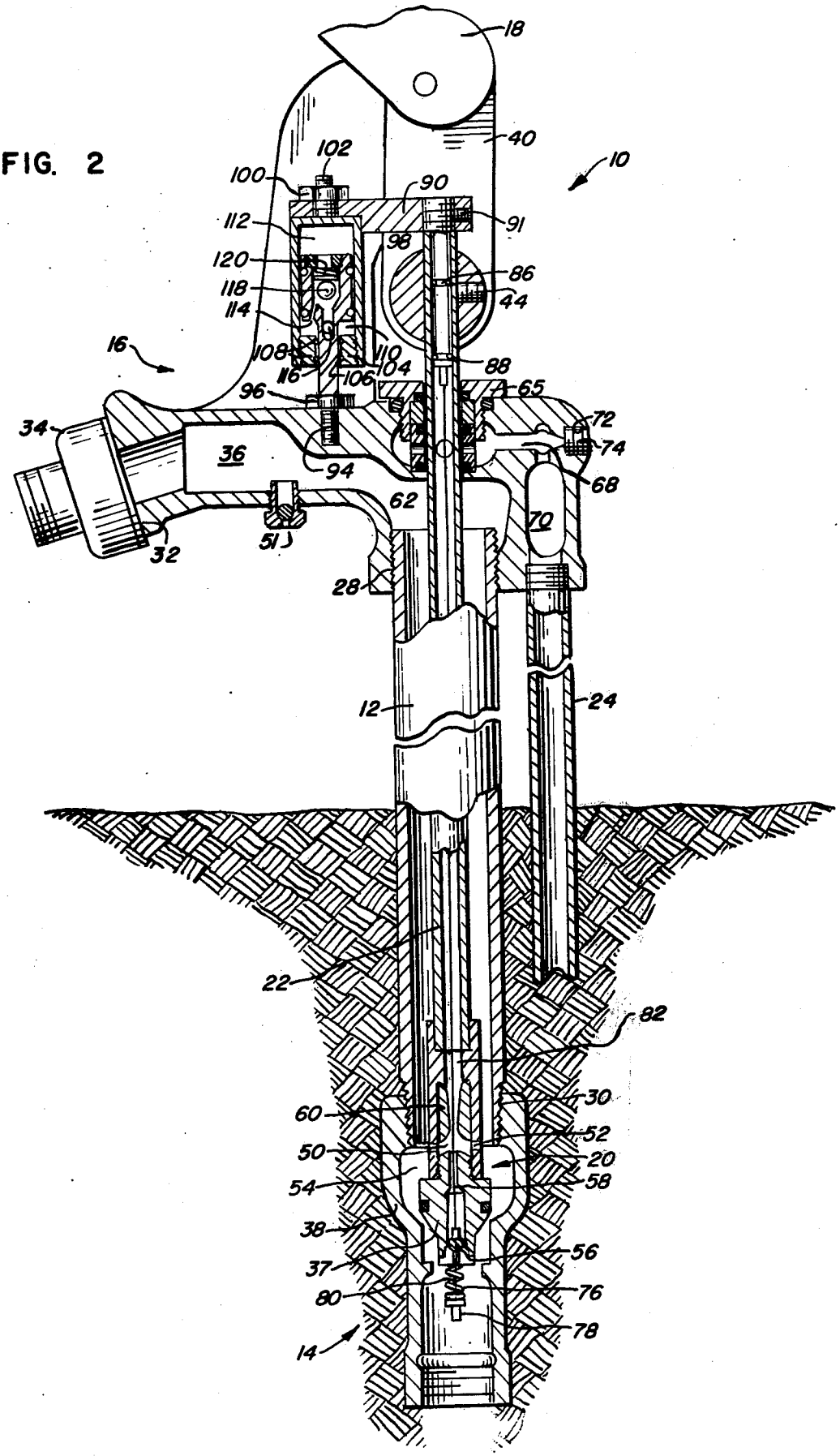
FIG. 2 is a view similar to FIG. 1 of the hydrant in its operating or supply position.

The ejector-purge apparatus 20 includes an outer body 42 threadably connected to the upper end of the main valve element 37 by the threads 44 fabricated on the main valve element 37. Accordingly, upon lifting of the handle 18 to the open position (FIG. 2), the purge conduit 22 is also lifted causing the main valve element 37 to be raised from its seating position (FIG. 1) to its valve open position (FIG. 2). In this main valve open position (FIG. 2), fluid from the fluid source is allowed to flow through the main valve 14 and enter the conduit 12 whereupon the fluid is directed out of the nozzle 32. This corresponds to the fluid supply mode of the hydrant 10 illustrated in FIG. 2.

Figure 3:
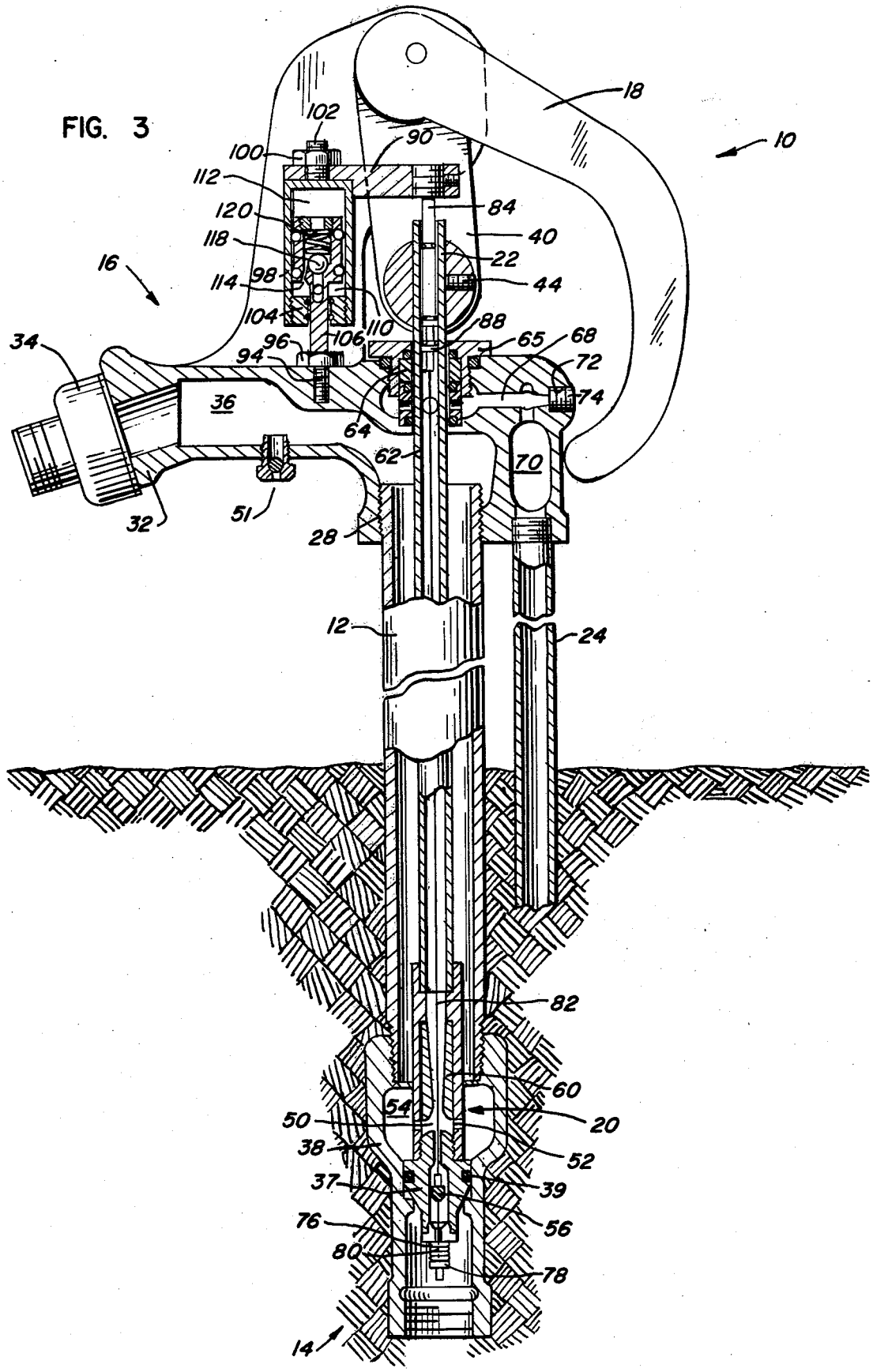
FIG. 3 is a view similar to FIGS. 1 and 2 of the hydrant in its purging position.

Upon completion of use of the hydrant 10, the handle 18 is returned to its normal, no-flow position (FIG. 3). This return operation of the handle 18 results in the movement of O-ring 39 against the main valve body 38 terminating flow from the fluid source through the casing 12. However, as is typical in hydrants of the type illustrated, a portion of the fluid is trapped within the casing 12 above the main valve element 34 upon terminating flow through the hydrant 10. Typically, a portion of this residual fluid within the casing 12 is above the frost line and is subject to being frozen if ambient temperatures drop to freezing levels.

In order to drain or evacuate this residual fluid from the casing 12, the ejector purge apparatus 20 is employed. The ejector purge apparatus 20 includes the valve housing or outer body 42 that is connected at its upper end to the purge conduit 22 and at its lower end to the main valve element 37. The interior of the valve housing 42 is in fluid communication with the fluid source through lower 46 and upper 48 orifices fabricated in the main valve element 37. The upper orifice 48 communicates with a fluid chamber 50 within the valve housing 42. The chamber 50 is also in fluid communication with a plurality of ports 52 fabricated in the valve housing 42. The ports 52 are in fluid communication with a chamber 54 defined by the main valve housing 38. Since the chamber 54 is in fluid communication with the interior of the casing 12, the purge valve chamber 50 is in fluid communication with the residual fluid within the casing 12 through ports 52.

The casing 12 is drained by venturi entrainment of the residual fluid through ports 52 into chamber 50 by a purge fluid flow through the ejector purge apparatus 20. Venturi evacuation of residual fluid is accomplished by creating a partial vacuum in the chamber 50. To allow free flow of the residual fluid under the influence of a vacuum in chamber 50, the casing 12 is maintained at atmospheric pressure by an air bleed 51 mounted in the head assembly 16 above the upper level of the residual fluid. To create a vacuum in chamber 50, a purge valve element 56 interacts with orifice 46 to control a reduced fluid flow from the source through a venturi throat 58 defined by a molded flow constricting element 60 mounted within the purge valve housing and adjacent to the chamber 50. By passing pressurized fluid (purge fluid flow) from the source through the throat 58, a pressure differential across the throat is created drawing or entraining the residual fluid through the ports 52 and into the purge fluid flow.

This combined flow is then communicated to the below grade gravel pit by way of the bleed pipe 24. More specifically, after passing through the throat 58, the combined fluid flows up the purge conduit 22 to an aperture 62 fabricated in the upper end of the purge conduit 22. The upper end of the conduit 22 is slidably mounted in the housing assembly 16 by a bushing 64 that is retained in assembly 16 by a cap 65. The aperture 62 communicates with the passages 66 fabricated in bushing 64 that are in fluid communication with the bleed pipe 24 through a bore 68 and an air gap 70 fabricated in the head assembly 16. The bore 68 is closed by a plug 74 during operation of the hydrant 10.

Since initiation of this purge flow through the ejector purge apparatus 20 is only necessary upon termination of the main fluid flow through the casing 12 and is only necessary for a period of time sufficient to drain the casing 12 of residual water, the dashpot 26 assembly is employed. The function of the dashpot 26 is to open the ejector purge apparatus 20 and maintain it open for a predetermined time to allow sufficient evacuation or draining of the casing 12. Moreover, dashpot 26 in combination with valve 56 prevents flow through the ejector purge apparatus 20 when the hydrant is in the fluid supply mode.

The dashpot 26 controls the duration of purge fluid flow and, thus, the duration of the evacuation operation by controlling the time period during which purge valve element 56 is unseated. More specifically, while the hydrant 10 is closed, the purge valve element 56 is normally held or seated in orifice 46 under the influence of the self-closure spring 76 thereby preventing purge fluid flow. The spring 76 is positioned in a spring retainer 78 and abuts against the bottom of the main valve element 37 in a manner such that tension is applied by the spring 76 to a wire or cable 80 that is secured at one end to retainer 78 and at the other end to the purge valve element 56.

The purge valve element is then connected by a second wire 82 to a plug 84 slidably and sealably mounted by O-rings 86 and 88 in the upper end of the purge conduit 22. The plug 84 is attached by a set screw 91 to an arm 90 that is secured to the dashpot 26. This structure of the arm 90, the plug 84, and the wire 82 provide the duration-controlling connection of the dashpot 26 to the purge valve element 56.

The dashpot 26 is a pneumatic or hydraulic time delay apparatus employing a piston 92 having a threaded extension 94 secured to the housing assembly 16 by a nut 96, thereby securing the piston 92 in a stationary position relative to the hydrant 10. The upper end of the piston 92 is of a cup shape configuration and is mounted within a cylindrical piston housing 98. The piston housing 98 is secured to the arm 90 by a nut 100 and a bolt 102. The lower end of the piston housing 98 is closed by a threaded plug 104. The threaded plug 104 includes an aperture 106 through which extends the extension 94 of the piston 92. The aperture 106 includes O-rings 108 to provide a seal and allow extension 94 to slide within the aperture 106. This structure allows the piston housing 98 to move vertically in a reciprocating fashion relative to the stationary piston 92.

The piston housing 98 is reciprocated by the handle 18. This reciprocation is accomplished by the securement of the handle 18 to the purge conduit 22 and the abutment of the upper end of the conduit 22 against the bottom of arm 90 (FIG. 1). More specifically, in the normal position of the hydrant 10 when there is no fluid flow, the handle 18 is down and the arm 90 rests on top of the upper end of the purge conduit 22. In this configuration, the piston 92 is positioned at the upper end of the housing 98. This position of the dashpot 26 is designated as the uncocked position (FIG. 1). To initiate flow through the hydrant 10, the arm 18 is raised causing the purge conduit 22 to rise thereby unseating the main valve 34. Simultaneously, as the conduit 22 rises it moves the arm 90 and the piston housing 98 upward. This latter position of the housing 98 relative to the piston 92 is designated the cocked position of the dashpot 26 (FIG. 2). The purge valve 20 remains closed in this position.

The dashpot 26 operates on the principle of allowing less restricted flow of air (or hydraulic fluid) in one direction than in a second direction. The rate of the more restricted flow is predetermined and functions to control the rate of return of the dashpot 26 from its cocked position immediately after termination of fluid flow through the hydrant 10 (FIG. 3) to its uncocked position after purging of the residual fluid (FIG. 1). To produce the dashpot effect, the size of the piston housing 98 relative to the size of piston 92 is such that in the uncocked position of the dashpot 26, there is a chamber of air or fluid 110 (FIG. 1) defined between the plug 104 and bottom of the cup of piston 92. In the cocked position of the dashpot 26, there is a different chamber of air or fluid 112 (FIG. 2) defined between the top of the piston 92 and the top of the piston housing 98. As the dashpot 26 is cocked, air or fluid is forced from the chamber 110 to the chamber 112 through metered orifice 114 fabricated in the piston 98. At the same time, air or fluid is also forced from the chamber 110 to the chamber 112 through a second, one-way orifice 116 fabricated in the piston 98. Flow through the orifice 116 is directionally controlled by a check valve 118 biased into a seating engagement with the orifice 116 by a spring 120. The valve 118 allows relatively unrestricted fluid flow from the chamber 110 to the chamber 112; however, the ball valve 118 prevents flow through orifice 116 from the chamber 112 to 110 (the movement of the dashpot 26 from its cocked to its uncocked position) and forces all flow through metered orifice 114 thereby resulting in a more restricted flow.

Accordingly, as the handle 18 is raised to initiate fluid flow through the hydrant 10, the dashpot 26 is cocked as the piston housing 98 is raised forcing fluid from the chamber 110 into the chamber 112 (FIG. 2). Fluid flow through the hydrant may be terminated by returning handle 18 to its original position. This operation causes the purge conduit 22 to return to its original position seating the main valve element 34 and trapping residual fluid in the casing 12. However, as the conduit 22 is lowered under the influence of the handle 18, fluid flow in the dashpot 26 from the chamber 112 to the chamber 110 is metered through orifice 114. Since the arm 90 is not connected to the conduit 22 and the plug 84 slides in the conduit, the piston housing 98 returns slowly to its original position under the influence of gravity and the self-closure spring 76 at a rate determined by the size of the orifice 114. Moreover, since the plug 84 is connected to the purge valve element 56 by the wire 82, as the main valve element 34 is returned to its seated position, the purge valve element 56 is returned at a slower rate controlled by the dashpot 26. Accordingly, the purge valve element 56 is held out of the orifice 46 initiating the purge fluid flow and, thus, the venturi purging of the residual fluid in a manner previously described. Once the piston housing returns to its original position, the purge valve element 56 is again seated in the orifice 46 terminating the purge operation. The delay time is selected for full purging of the casing 12.

Many modifications and variations of the present invention are possible in light of the above teachings. Thus, it is to be understood that within the scope of the appended claims, the invention may be practiced otherwise than as specifically described above.

What is claimed and desired to be secured by Letters Patent of the United States is:

1. In a hydrant for controlling fluid flow from a fluid supply including a housing having a lower portion connected to said supply and an upper portion;

means connected to said upper portion for delivery of fluid from said upper portion;

means for controlling fluid flow from said supply to said lower portion, said controlling means including a handle mounted on said hydrant and a main fluid supply valve connected to said handle, said handle being movable between a closed position and a fluid supply position, the improvement comprising means for draining said housing of fluid remaining in said housing after termination of fluid flow, said draining means including a conduit within said housing and having an inlet adapted to communicate with said fluid supply and an outlet external to said housing, means establishing communication between the interior of said housing and said conduit, and valve means associated with said conduit inlet and movable from a closed to an open position upon movement of said handle from said fluid supply position to said closed position, whereby fluid remaining in said housing flows into said conduit and out of said outlet with fluid flowing through said valve means and said conduit, and means for automatically controlling the duration that said valve means is in said open position after said handle is moved to said closed position thereby controlling the duration of said draining of said housing by said draining means.

2. The hydrant claimed in claim 1, said main supply valve is provided at the lower portion of said housing and said conduit extends upwardly to said upper portion of said housing from said main fluid supply valve.

3. The hydrant claimed in claim 2, said draining means further including a fluid flow constricting element in controlled fluid communication with said fluid source and with said conduit.

4. The hydrant claimed in claim 1, said automatic controlling means comprising a motion dampening device for dampening the movement of said valve means from said open to said closed position.

5. The hydrant claimed in claim 4 said motion dampening device including a fluid dashpot connected to said valve means and actuated by said handle.

6. A hydrant for controlling the flow of water from a water source comprising a casing connected at a first end to said source and at a second end to a head for delivery of said water from said casing, a main valve connected to said casing controlling the flow of water from said source to said casing, said main valve actuated by a handle on said hydrant, said handle being moveable between a closed position and a water supply position means for evacuating water from said casing, said evacuating means including a conduit within said casing and having an inlet adapted to communicate with said water source and an outlet external to said casing, means establishing communication between the interior of said casing and said conduit, and valve means associated with said conduit inlet and movable from a closed to an open position upon movement of said handle from said water supply position to said closed position, whereby water remaining in said casing flows into said conduit and out of said outlet with water flowing through said valve means and said conduit, and means for controlling the rate of movement of said valve means from said open to said closed position after said handle is moved to closed position.

7. The hydrant set forth in claim 6, said evacuating means further including a flow constricting element defined in said conduit, and ports in said conduit adjacent said flow constricting element and in fluid communication with said casing.

8. The hydrant set forth in claim 6, said controlling means comprising a motion dampening dashpot connected to said valve means.

9. The hydrant set forth in claim 8, said dashpot also connected to said handle and cocked by said handle upon movement of the handle to said water supply position to initiate water flow through said hydrant, and said dashpot being released for operation in response to movement of said handle to said closed position and termination of said water flow.

10. In combination a hydrant for controlling the flow of water from an underground source comprising a casing having a lower portion connected to said source, and an intermediate portion connected to said lower portion, a nozzle portion connected to said intermediate portion for the delivery of water from said casing, a main valve within said casing for controlling the flow of water from said source to said casing, said main valve movable from a first position wherein said main valve prevents flow of water from said source to a second position wherein said main valve allows flow from said source to said casing, means for operating said main valve, and means for evacuating said casing of residual water after said main valve has terminated flow of water from said source to said casing, said evacuating means comprising a fluid conduit having an inlet in controlled fluid communication with said source and an outlet adapted to be located outside of said casing, a purge valve movably mounted adjacent said inlet of said conduit for controlling the flow of water from said source to said conduit, said purge valve movable by said operating means from a first flow blocking position to a second position allowing flow from said source to said conduit as said operating means moves said main valve from said second position to said first position, and means for controlling the rate of movement of said purge valve from said second position to said first position, said controlling means actuated by said operating means as said operating means moves said main valve from said first position to said second position, said controlling means being released for operation in response to said operating means moving said main valve from said second position to said first position.

11. The combination claimed in claim 10, said fluid conduit further including a fluid flow constricting element defining a venturi throat adjacent said inlet.

12. The combination claimed in claim 11, said fluid conduit further including at least one port adjacent said throat and in fluid communication with said casing.

13. The combination claimed in claim 10, said controlling means comprising a motion dampening dashpot.

14. The combination claimed in claim 13, said dashport being a fluid pressure responsive device.

* * * * *